US010906079B2

(12) United States Patent
Maeda et al.

(10) Patent No.: US 10,906,079 B2
(45) Date of Patent: Feb. 2, 2021

(54) MANUFACTURING METHOD AND MANUFACTURING DEVICE FOR COMPOSITE CROSS-SECTION MEMBER

(71) Applicant: Kobe Steel, Ltd., Hyogo (JP)

(72) Inventors: Yasuhiro Maeda, Kobe (JP); Toru Hashimura, Kobe (JP); Ryohei Yukishige, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 51 days.

(21) Appl. No.: 16/090,822

(22) PCT Filed: Apr. 5, 2017

(86) PCT No.: PCT/JP2017/014204
§ 371 (c)(1),
(2) Date: Oct. 3, 2018

(87) PCT Pub. No.: WO2017/187910
PCT Pub. Date: Nov. 2, 2017

(65) Prior Publication Data

US 2019/0091747 A1 Mar. 28, 2019

(30) Foreign Application Priority Data

Apr. 28, 2016 (JP) ..... 2016-091533

(51) Int. Cl.
*B21D 5/08* (2006.01)
*B21D 47/04* (2006.01)
*B21F 99/00* (2009.01)

(52) U.S. Cl.
CPC ..... *B21D 5/08* (2013.01); *B21D 47/04* (2013.01); *B21F 99/00* (2013.01)

(58) Field of Classification Search
CPC .. B21D 5/08; B21D 47/04; B21D 5/12; E04F 13/12; B32B 37/00; B32B 37/16; B32B 31/04; B29D 9/00
See application file for complete search history.

(56) References Cited

U.S. PATENT DOCUMENTS 4,264,030 A * 4/1981 Bergan ..... A47J 36/02 156/216
5,403,986 A * 4/1995 Goleby ..... B21D 5/08 219/61.2

(Continued)

FOREIGN PATENT DOCUMENTS

JP S49-003529 B 1/1974
JP S54-117369 A 9/1979

(Continued)

OTHER PUBLICATIONS

Notification of Transmittal of Translation of the International Preliminary Report on Patentability (Chapter I) and Translation of Written Opinion of the International Searching Authority; PCT/JP2017/014204; dated Nov. 8, 2018.

*Primary Examiner* — Lawrence Averick
(74) *Attorney, Agent, or Firm* — Studebaker & Brackett PC

(57) ABSTRACT

In a method for manufacturing a composite cross-section member, a continuous steel sheet is fed to a manufacturing device and bent and roll-formed into a predetermined cross-sectional shape, a discontinuous aluminum core is locally inserted at an arbitrary stage of the roll forming, and the steel sheet is bent such that the core and the steel sheet are integrated, to obtain a composite cross-section member.

12 Claims, 11 Drawing Sheets

(56) References Cited

U.S. PATENT DOCUMENTS

| | | | | |
|---|---|---|---|---|
| 5,794,400 | A * | 8/1998 | Fisher | E04F 10/02 156/294 |
| 6,283,159 | B1 | 9/2001 | Tada | |

FOREIGN PATENT DOCUMENTS

| | | | |
|---|---|---|---|
| JP | S59-038056 | B2 | 9/1984 |
| JP | S62-3829 | A | 1/1987 |
| JP | 2000-140933 | A | 5/2000 |
| JP | 2003-312404 | A | 11/2003 |
| JP | 2003-326318 | A | 11/2003 |
| JP | 2013-184198 | A | 9/2013 |

* cited by examiner

MANUFACTURING METHOD AND MANUFACTURING DEVICE FOR COMPOSITE CROSS-SECTION MEMBER

CROSS-REFERENCE TO RELATED APPLICATIONS

This is a national phase application in the United States of International Patent Application No. PCT/JP2017/14204 with an international filing date of Apr. 5, 2017, which claims priority of Japanese Patent Application No. 2016-091533 filed on Apr. 28, 2016, the contents of which are incorporated herein by reference.

TECHNICAL FIELD

The present disclosure relates to a method and a device for manufacturing a composite cross-section member.

BACKGROUND ART

Due to an increase in strength of steel sheets accompanied by reduction in weight of automobiles, when press molding is used to form a steel sheet, cracking and spring back occur during the forming. In contrast, in roll forming, a steel sheet is formed by bending at a single stage or sequentially formed at multiple stages, and it is thereby possible to form a steel sheet with high strength, which is normally difficult in the press molding. The roll forming is particularly suitable for manufacturing parts in a uniform cross-sectional shape.

Contrary to the reduction in weight of automobiles, crash standards are becoming stricter year by year, and the strength required for members is on the increase. In order to increase the strength of the member, it is conceivable to change the shape or dimensions of a portion particularly required to have high strength. However, for example, in the roll forming, the cross-sectional shape or the sheet thickness cannot be locally changed, and the parts needs to be changed as a whole in the longitudinal direction. Therefore, in the roll forming, it is difficult to improve the local strength of the member. As thus described, it is difficult to achieve both reduction in weight and increase in strength of parts.

JP 2003-312404 A discloses a composite structural member having achieved both reduction in weight and increase in strength by integrally forming a steel sheet and a light-alloy member.

SUMMARY OF THE INVENTION

Problems to be Solved by the Invention

JP 2003-312404 A does not include specific descriptions regarding method for manufacturing the composite structural member, and it is difficult to manufacture the composite structural member.

Embodiments of the present invention have been made under these circumstances, and an object of the present invention is to provide a method for manufacturing a composite cross-section member light in weight and locally high in strength.

Means for Solving the Problems

A method for manufacturing a composite cross-section member in a first aspect of the present invention includes: feeding a continuous metal strip to a roll former for bending and roll forming the metal strip into a predetermined cross-sectional shape; locally inserting a discontinuous light-metal core at an arbitrary stage of the roll forming; and bending the metal strip so as to integrate the core and the metal strip and obtaining a composite cross-section member.

According to this method, by locally inserting the discontinuous core only into a portion required to have bending strength in the roll forming, it is possible to reduce an increase in weight of the entire member and obtain a composite cross-section member with locally high strength. Further, this method can be realized by adding equipment for inserting the core to an existing roll former, so that it is possible to effectively utilize the existing roll former and to reduce a cost increase caused by new capital investment.

The roll former may include an upper roll and a lower roll that has a complementary shape with the upper roll, and a distance between the upper roll and the lower roll in a process after the insertion of the core may match a total of a thickness of the core and a thickness of the metal strip.

According to this method, the core serves as a part of the upper roll and presses down the metal strip, thereby enabling downsizing of the upper roll. Further, in the case of forming the metal strip into a closed cross-sectional shape, the forming stability improves when the core is inserted, and the metal strip is formed in an internally dense state rather than formed in a hollow state.

The method for manufacturing a composite cross-section member may further include disposing an insulator on at least a part of a contact portion between the metal strip and the core.

According to this method, it is possible to prevent electrolytic corrosion in a dissimilar metal by disposing (e.g., applying) an insulator such as an adhesive on a joint portion between the metal strip and the core. For example, as the insulator, an adhesive with insulating properties may be used. The insulator may be previously applied to the core before the forming or may be applied to the metal strip or the core during the forming.

The roll former may be provided with an escape portion corresponding to a portion where the insulator is disposed.

According to this method, by providing the escape portion, an insulator such as the adhesive does not adhere to the roll former. Hence, it is possible to continuously use the roll former without maintenance such as cleaning.

The method for manufacturing a composite cross-section member may further include cutting the composite cross-section member into a predetermined length, and bending the composite cross-section member.

According to this method, by bending the composite cross-section member that has the core inside in a direction in which the metal strip is fed, a longitudinal bending shape can be imparted to the composite cross-section member, and the core can be caulked to the metal strip and fixed thereto.

The method for manufacturing a composite cross-section member may further include forming the metal strip into a predetermined cross-sectional shape and then welding the metal strip into a closed cross-sectional shape.

According to this method, it is possible to obtain a composite cross-section member in a closed cross-sectional shape completely closed by welding.

A device for manufacturing a composite cross-section member in a second aspect of the present invention includes: a roll former that is made up of a plurality of roll pairs each including an upper roll and a lower roll which has a complementary shape with the upper roll, and roll-forms a continuous metal strip fed to the plurality of roll pairs into a predetermined cross-sectional shape; and a core insertion unit that inserts a discontinuous light-metal core upstream of a first roll pair out of the plurality of roll pairs or between the first roll pair and a second roll pair, wherein the metal strip is bent so as to integrate the core and the metal strip by the roll former, and a composite cross-section member is obtained.

According to the present invention, by inserting the core only into a portion required to have bending strength, it is possible to reduce an increase in weight of the entire member and obtain a composite cross-section member with locally high strength.

DESCRIPTION OF EMBODIMENTS

Embodiments of the present invention will be described below with reference to the accompanying drawings.

In each of the embodiments described below, materials for individual members will be exemplified, but the materials for the individual members are not limited to those exemplified specifically in all the embodiments, and the present invention is applicable to any material.

First Embodiment

Figure 1:
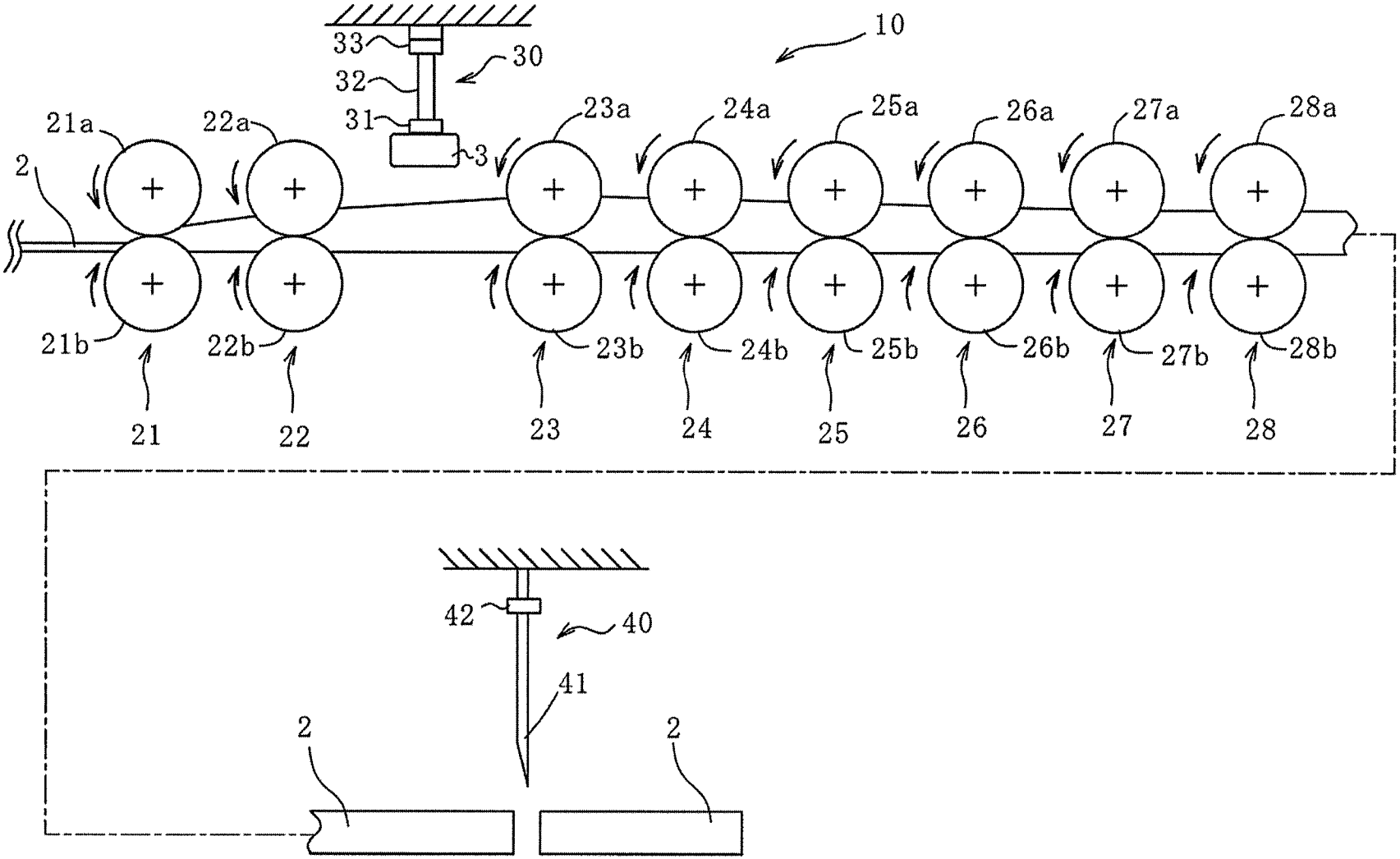
FIG. 1 is a side view of a device for manufacturing a composite cross-section member according to a first embodiment of the present invention.

As shown in FIG. 1, a method for manufacturing a composite cross-section member 1 of the present embodiment is a method in which a steel sheet (metal strip) 2 and an aluminum core 3 are integrally formed by roll forming to obtain a composite cross-section member 1 (cf. FIG. 2D) in a predetermined cross-sectional shape.

In this method for manufacturing the composite cross-section member 1, the continuous steel sheet 2 is fed to a roll former 10 and bent and roll-formed into a predetermined cross-sectional shape. At that time, the discontinuous aluminum core 3 is locally inserted at an arbitrary stage of the roll forming, and the steel sheet 2 is bent such that the core 3 and the steel sheet 2 are integrally formed, to obtain the composite cross-section member 1.

The steel sheet 2 is made of steel and is continuous. Further, the thickness and width of the steel sheet 2 are defined to dimensions to such an extent that the steel sheet 2 can be bent (cf. FIGS. 2B to 2D).

The core 3 is made of aluminum and is discontinuous, namely, defined to have a predetermined length. Here, the predetermined length of the core 3 is determined in accordance with the roll former 10 as described later. Further, the core 3 is in a hollow shape having two through holes 3*a*, 3*b* in front view (cf. FIGS. 2C and 2D). The dimensions of the core 3 are defined to such an extent that the core 3 can be inserted inside the steel sheet 2 when the steel sheet 2 is bent. The material for the core 3 is not particularly limited as long as being made of light metal, other than aluminum.

Figure 2A:
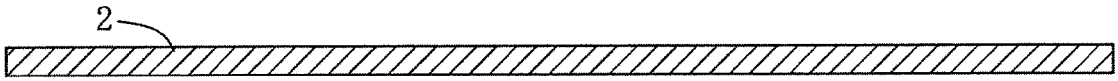
FIG. 2A is a front sectional view showing each manufacturing process of the composite cross-section member of FIG. 1.
Figure 2B:
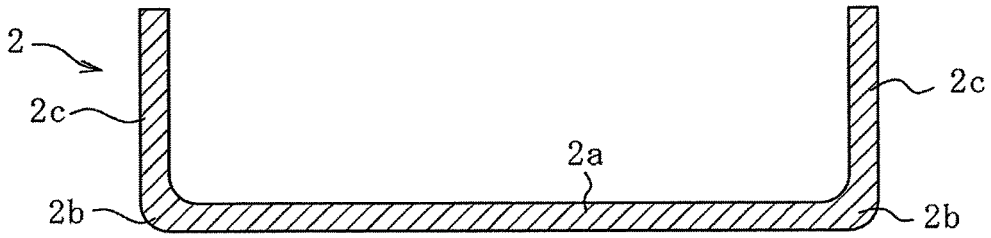
FIG. 2B is a front sectional view showing each manufacturing process of the composite cross-section member of FIG. 1.
Figure 2C:
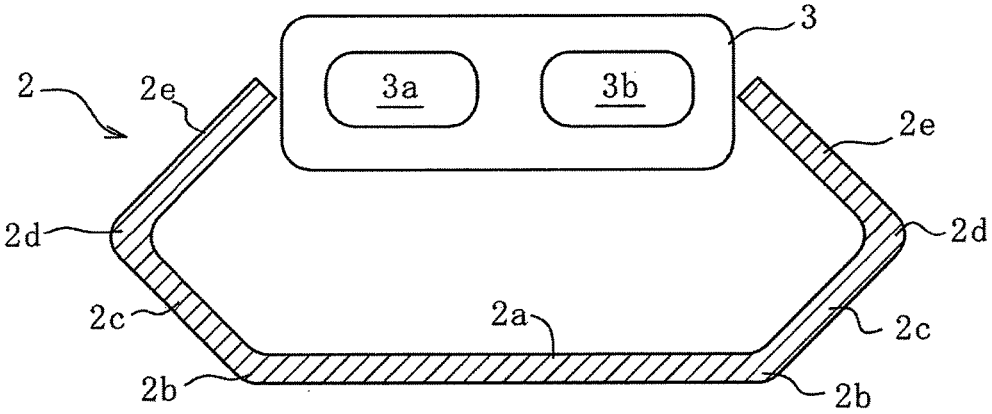
FIG. 2C is a front sectional view showing each manufacturing process of the composite cross-section member of FIG. 1.
Figure 2D:
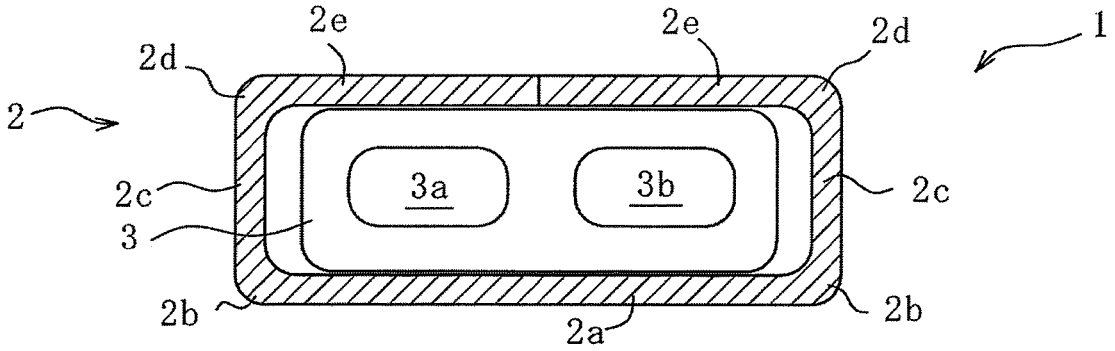
FIG. 2D is a front sectional view showing each manufacturing process of the composite cross-section member of FIG. 1.

With reference to FIGS. 2A to 2D, a formation process for the composite cross-section member 1 of the present embodiment will be described. As shown in FIG. 2A, the steel sheet 2 before the forming has a flat sheet shape. Next, as shown in FIG. 2B, a bottom sheet 2*a* and side sheets 2*c* rising from both ends 2*b* of the bottom sheet 2*a* are formed. Then, as shown in FIG. 2C, a top sheet 2*e* extending obliquely inward from the upper ends 2*d* of the side sheets 2*c* is formed. At this time, the core 3 is inserted into the steel sheet 2 and placed on the bottom sheet 2*a*. Finally, as shown in FIG. 2D, the core 3 is covered with the bottom sheet 2*a*, the side sheets 2*c*, and the top sheet 2*e* to form the composite cross-section member 1 in a closed cross-sectional shape.

With reference to FIG. 1 and FIGS. 3A to 3H, a manufacturing device and a manufacturing process for the composite cross-section member 1 of the present embodiment will be described.

The manufacturing device of the present embodiment includes a roll former 10 including roll pairs 21 to 28, a robot arm 30, and a cutter 40.

The roll pairs 21 to 28 have an eight-stage configuration, and the composite cross-section member 1 is formed separately in first to eighth steps. The roll pairs 21 to 28 at the respective stages include upper rolls 21*a* to 28*a* and lower rolls 21*b* to 28*b*. The upper rolls 21*a* to 25*a* are provided with convex portions 21*c* to 25*c* having convex shapes toward the lower rolls 21*b* to 25*b*. The lower rolls 21*b* to 25*b* have concave portions 21*d* to 25*d* in complementary shapes with the convex portions 21*c* to 25*c*. The upper rolls 21*a* to 28*a* and the lower rolls 21*b* to 28*b* are rotatably journaled and driven to rotate by a drive mechanism (not shown). The steel sheet 2 fed to the roll pairs 21 to 28 is sandwiched between the upper rolls 21*a* to 28*a* and the lower rolls 21*b* to 28*b*, which are driven to rotate, and is formed into a predetermined cross-sectional shape. In the present embodiment, the upper rolls 21*a* to 28*a* and the lower rolls 21*b* to 28*b* are arranged in a vertical direction, but a side roll may be additionally arranged in a horizontal direction to form the steel sheet 2. Note that the upper rolls 21*a* to 28*a* and the lower rolls 21*b* to 28*b* include the descriptions of "upper" and "lower" as names, but these are names for convenience, and the upper rolls 21*a* to 28*a* and the lower rolls 21*b* to 28*b* are not necessarily arranged in the vertical direction. For example, the upper rolls 21*a* to 28*a* and the lower rolls 21*b* to 28*b* may be rotated by 90 degrees in front view, namely, arranged in the horizontal direction.

In the present embodiment, the robot arm (core insertion unit) 30 for inserting the core 3 is provided between the second and third stage roll pairs 22, 23. The robot arm 30 includes a grip unit 31, an arm 32, and an operation unit 33. The grip unit 31 is disposed at the lower end of the robot arm 30 and is a portion that grips the core 3. One end of the arm 32 is connected to the grip unit 31, and the other end is connected to the operation unit 33. The operation unit 33 is a portion that operates the arm 32 and causes the grip unit 31 connected to the arm 32 to move vertically and rotate. Therefore, the robot arm 30 can insert the core 3 into the steel sheet 2 being formed at an arbitrary position and angle (cf. FIG. 2C). The predetermined length of the core 3 of the present embodiment is equal to or smaller than the length between the second and third stage roll pairs 22, 23. In the present embodiment, the second and third stage roll pairs 22, 23 constitute a first roll pair and a second roll pair, respectively. Note that the robot arm 30 may be disposed at an arbitrary position during the forming process and is not limited to between the second and third stage roll pairs 22, 23. Moreover, the robot arm 30 may be disposed upstream of the first stage roll pair 21, and in that case, the first stage roll pair 21 constitutes the first roll pair.

Figure 3A:
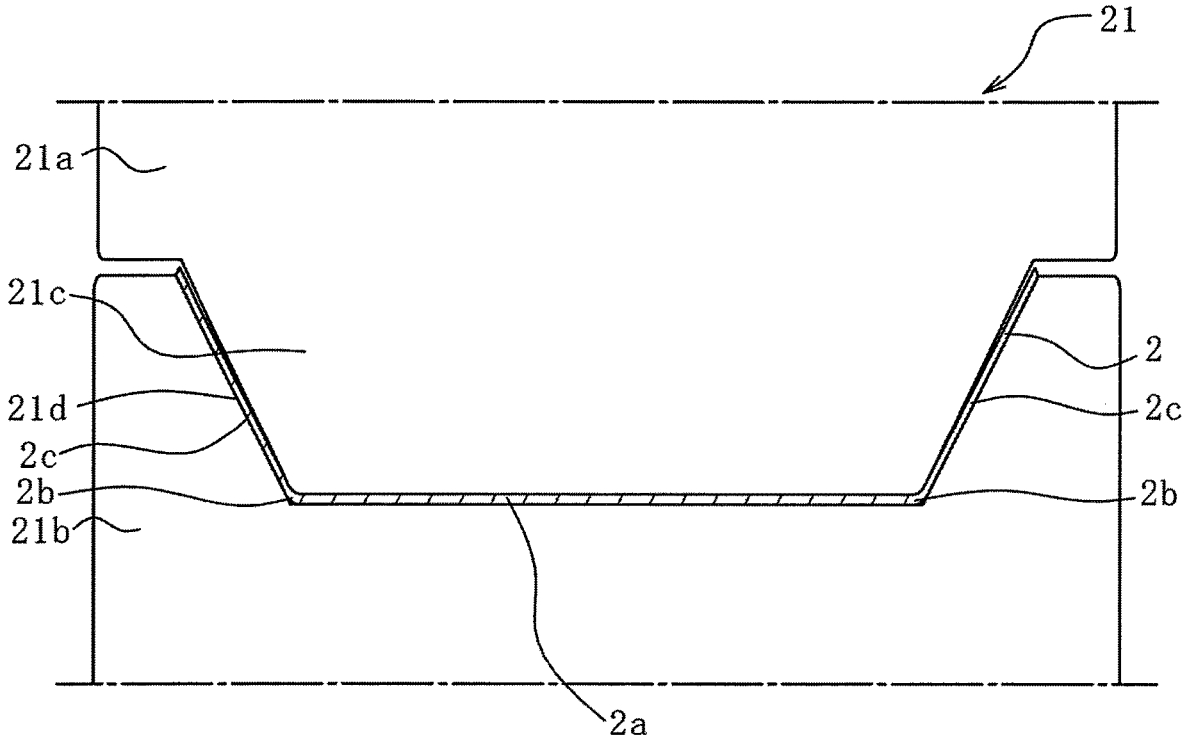
FIG. 3A is a partial front sectional view of a first step of FIG. 1.

In the first step, as shown in FIG. 3A, in the first stage roll pair 21, both ends of the steel sheet 2 are bent and raised by about 45□ from the horizontal direction at corners 2*b*, to form the bottom sheet 2*a* and the oblique side sheets 2*c*.

Figure 3B:
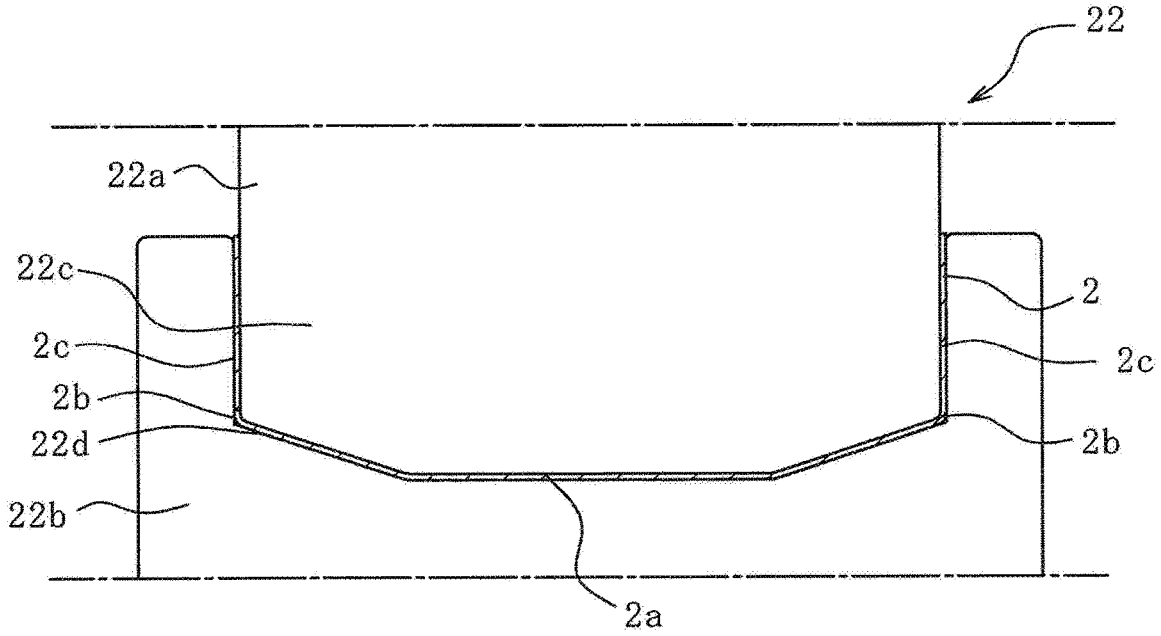
FIG. 3B is a partial front sectional view of a second step of FIG. 1.

As shown in FIG. 3B, in the second step, in the second stage roll pair 22, both ends of the steel sheet 2 are bent and raised by about 90□ from the horizontal direction, to form the vertical side sheets 2*c*. FIG. 3B showing the present step corresponds to FIG. 2B. Further, in the present step, the center of the convex portion 22*c* of the upper roll 22*a* bulges downward. As a result, the center of the bottom sheet 2*a* after the present process is pressed to a position lower than the other portions, to facilitate the subsequent bending process.

Figure 3C:
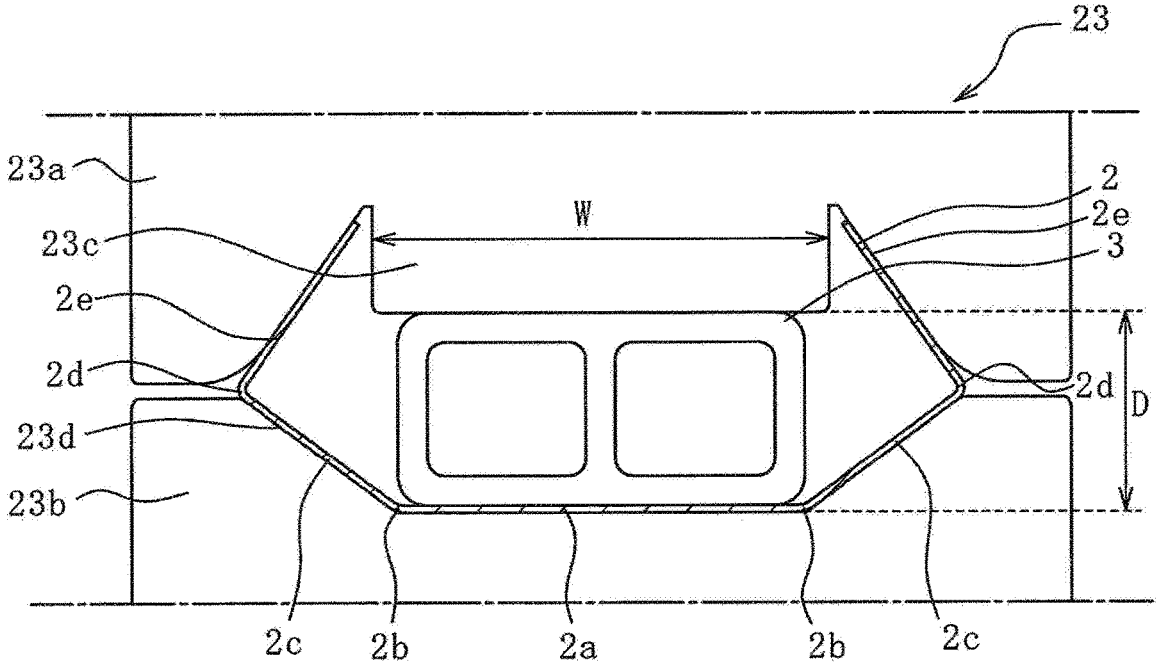
FIG. 3C is a partial front sectional view of a third step of FIG. 1.

As shown in FIG. 3C, prior to the third step, the core 3 is inserted into the bent steel sheet 2. In the third step, in the third stage roll pair 23, the steel sheet 2 is bent at the corners 2*d* so that the steel sheet 2 envelops the core 3, to form the top sheet 2*e*. FIG. 3C showing the present step corresponds to FIG. 2C. In the third stage roll pair 23, the convex portion 23*c* of the upper roll 23*a* is made smaller than the convex portions 21*c*, 22*c* of the upper rolls 21*a*, 22*a* in the first step and the second step by the thickness of the core 3. That is, a distance D between the convex portion 23*c* of the upper roll 23*a* and the concave portion 23*d* of the lower roll 23*b* matches the sum of the thickness of the core 3 and the thickness of the steel sheet 2. This also applies to the fourth and subsequent steps.

Figure 3D:
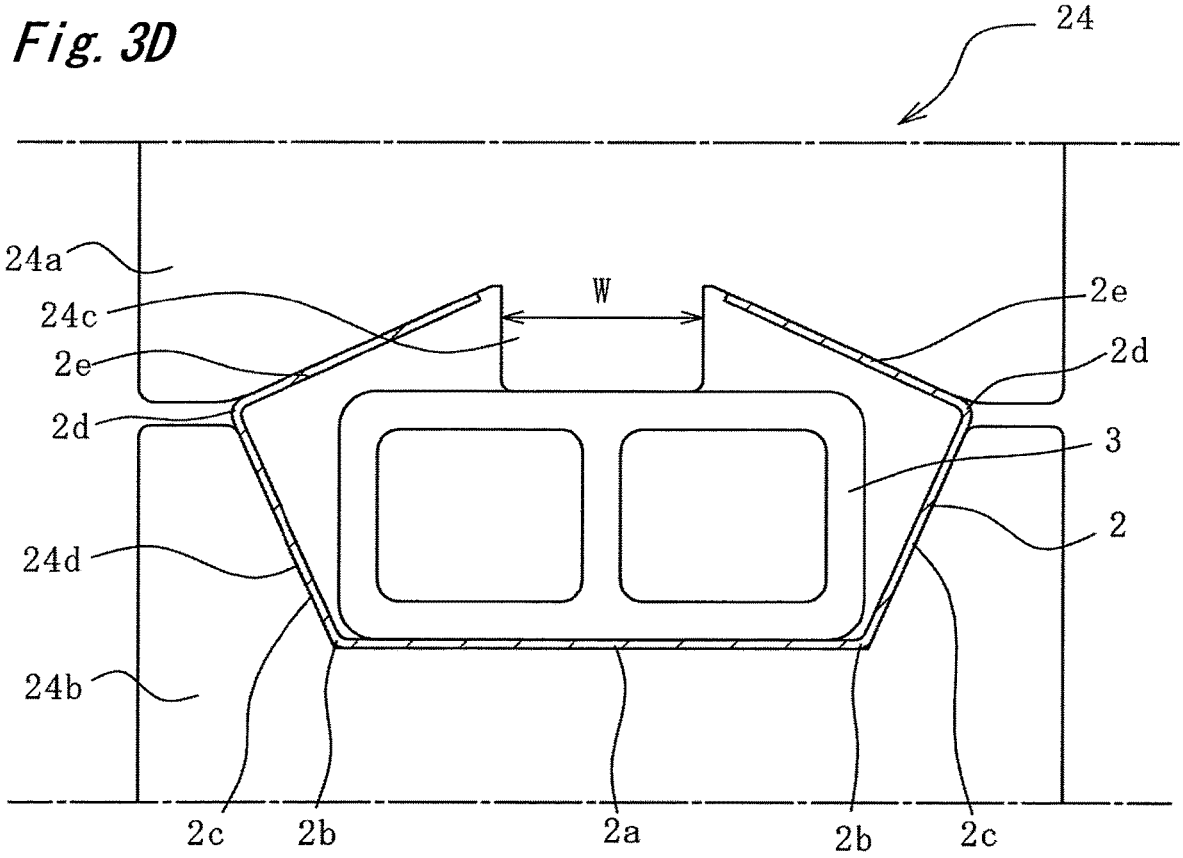
FIG. 3D is a partial front sectional view of a fourth step of FIG. 1.

As shown in FIG. 3D, in the fourth step, in the fourth stage roll pair 24, the steel sheet 2 is bent such that the core 3 is further enveloped with the steel sheet 2. In order to bend the steel sheet 2 inward, the convex portion 24*c* of the upper roll 24*a* is formed to have a lateral width W narrower than the convex portion 23*c* of the upper roll 23*a* in the third step.

Figure 3E:
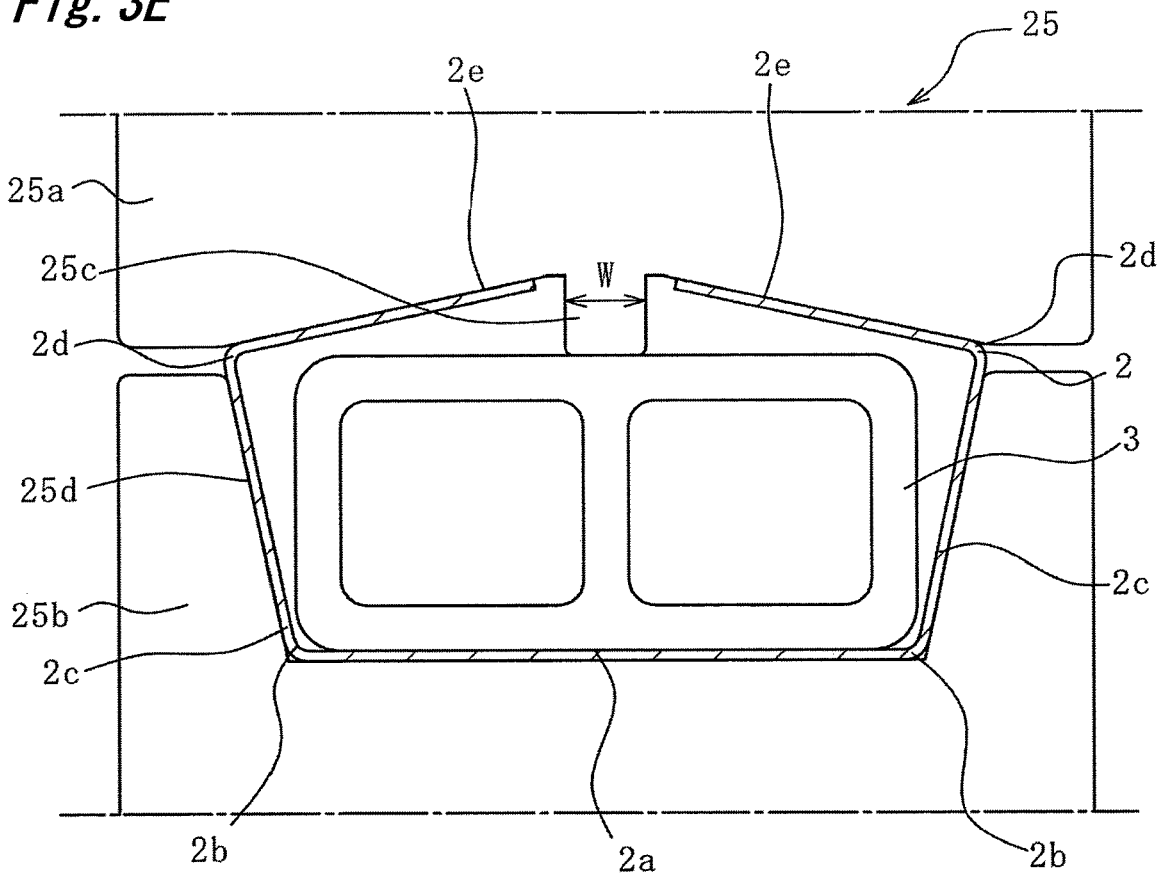
FIG. 3E is a partial front sectional view of a fifth step of FIG. 1.

As shown in FIG. 3E, in the fifth step, in the fifth stage roll pair 25, the steel sheet 2 is bent such that the core 3 is further enveloped with the steel sheet 2. In order to bend the steel sheet 2 further inward, the convex portion 25*c* of the upper roll 25*a* is formed to have the lateral width W narrower than the convex portion 24*c* of the upper roll 24*a* in the fourth step.

Figure 3F:
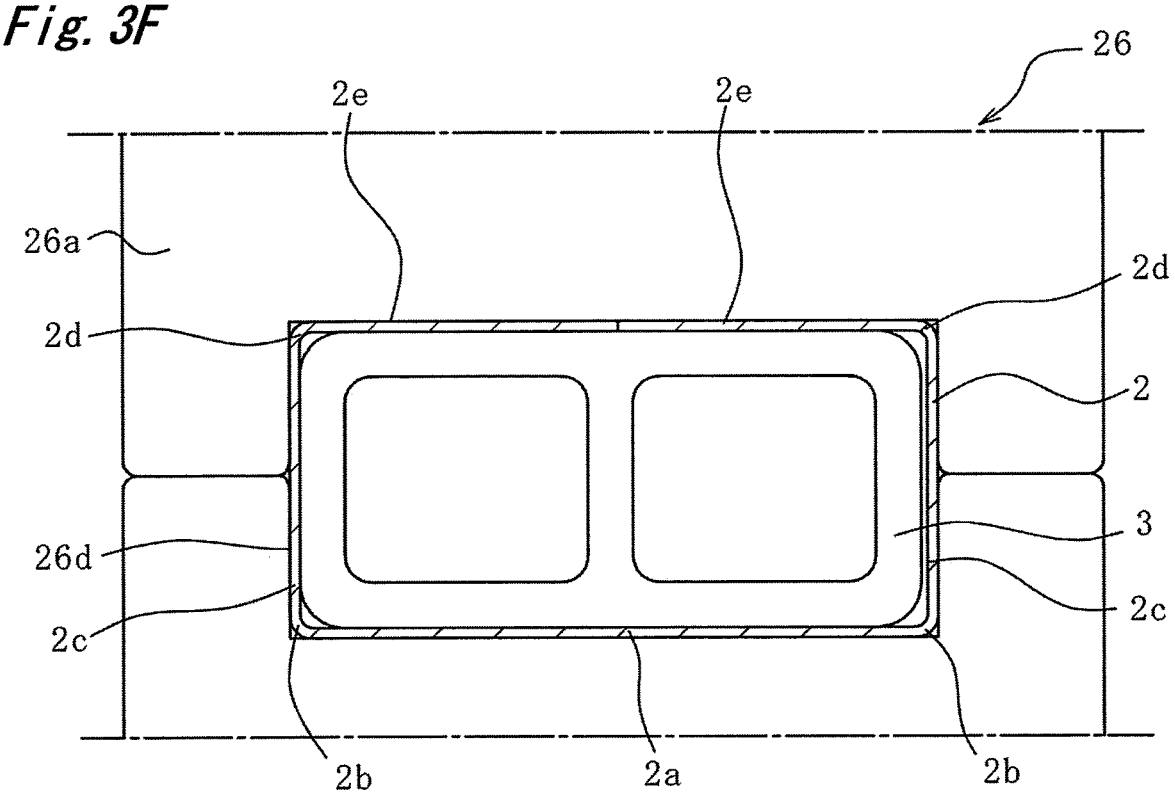
FIG. 3F is a partial front sectional view of a sixth step of FIG. 1.

As shown in FIG. 3F, in the sixth step, in the sixth stage roll pair 26, the steel sheet 2 is bent such that the core 3 is completely enveloped with the steel sheet 2. In order to form the steel sheet 2 in the closed cross-section, in the sixth and subsequent steps, the upper rolls 26*a* to 28*a* do not have convex portions. That is, the lateral width W in each of the convex portions of the upper rolls 21*a* to 25*a* decreases as the step goes downstream from the first step to the fifth step, and the lateral width W is nonexistent in the sixth and subsequent steps.

Figure 3G:
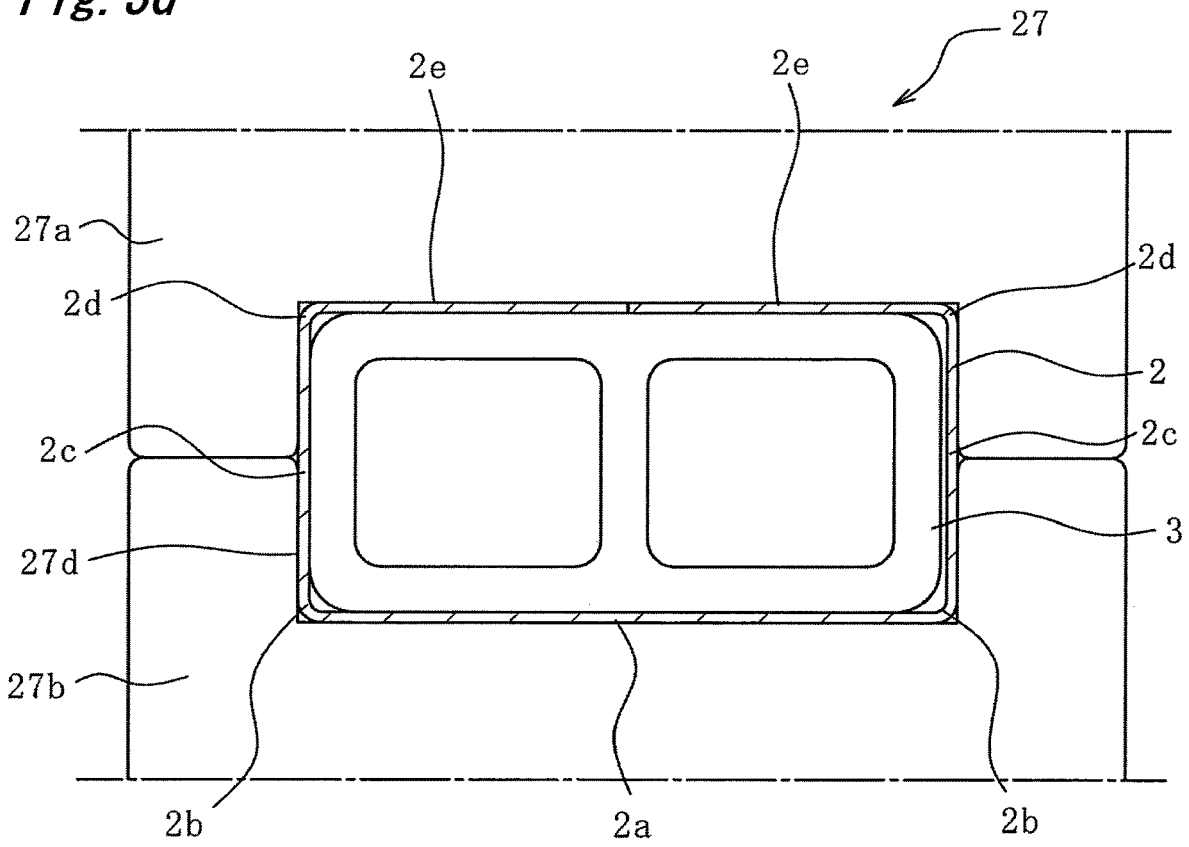
FIG. 3G is a partial front sectional view of a seventh step of FIG. 1.

As shown in FIG. 3G, in the seventh step, in the seventh stage roll pair 27, the composite cross-section member 1 is bent so as to accurately have a predetermined closed cross-sectional shape. The roll pair 27 in the seventh step has substantially the same shape as the roll pair 26 in the sixth step.

Figure 3H:
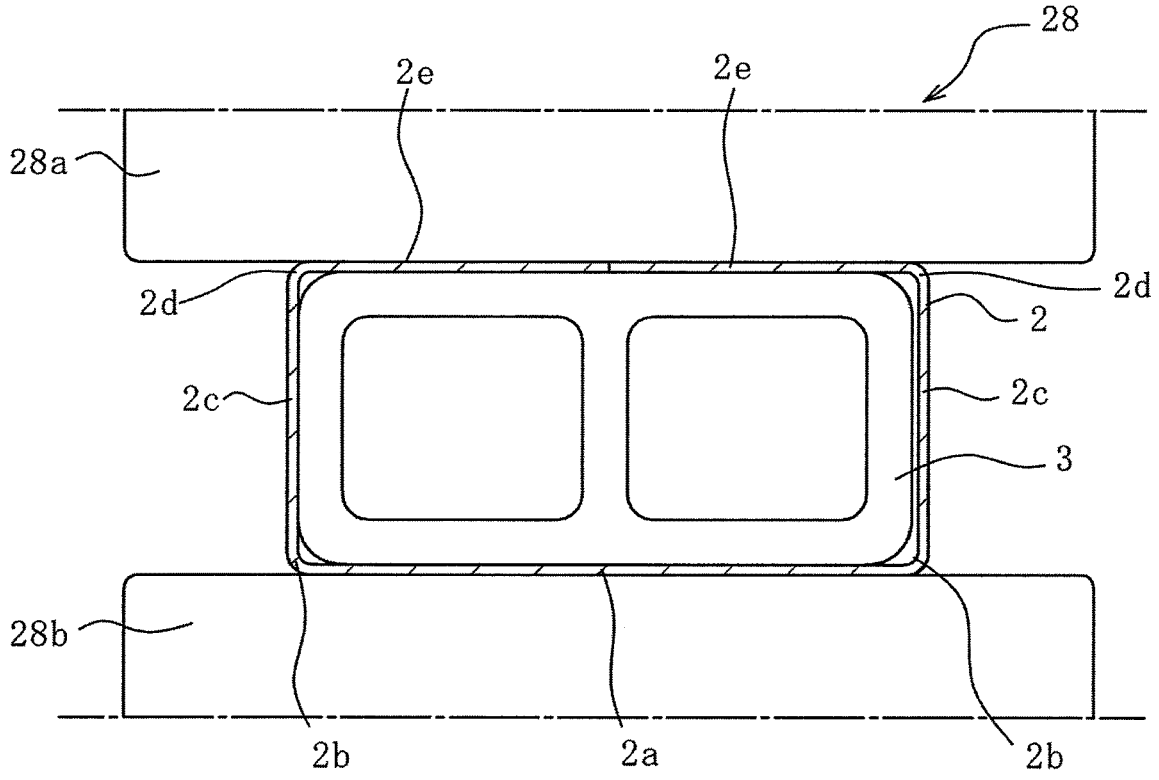
FIG. 3H is a partial front sectional view of an eighth step of FIG. 1.

As shown in FIG. 3H, in the eighth step, in the eighth stage roll pair 28, the composite cross-section member 1 is pressed from above and below to form the upper and lower surfaces of the composite cross-section member 1 flat and also adjust the shape thereof.

Moreover, in the present embodiment, after the eighth step, a step of cutting the composite cross-section member 1 to a predetermined length is provided. This cutting is performed by the cutter 40. The cutter 40 has a blade 41 at the lower end for cutting the composite cross-section member 1, and an operating section 42 at the top for vertically operating the blade 41.

According to the above method, by inserting the core 3 only in the portion required to have bending strength in the roll forming, it is possible to reduce an increase in weight of the entire composite cross-section member 1 and obtain the composite cross-section member 1 with locally high strength. Further, this method can be realized by adding the robot arm 30 which is the equipment for inserting the core 3 to the existing roll former, so that it is possible to effectively utilize the existing roll former and to reduce a cost increase caused by new capital investment.

In the third to fifth steps, with the core 3 serving as the convex portions 23*c* to 25*c* of the upper rolls 23*a* to 25*a* to press down the steel sheet, the convex portions 23*c* to 25*c* of the upper rolls 23*a* to 25*a* can be reduced in convex amount by the thickness of the core 3 and can thus be downsized. Further, in the case of forming the steel sheet 2 into a closed cross-sectional shape as in the present embodiment, the forming stability improves by inserting the core 3 and forming the steel sheet 2 in an internally dense state rather than forming the steel sheet 2 in a hollow state.

Figure 4:
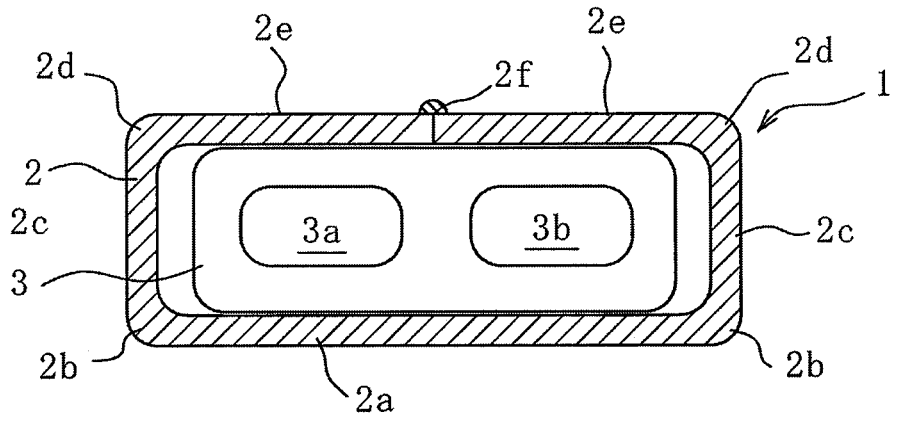
FIG. 4 is a front sectional view of a composite cross-section member showing a modification of FIG. 2D.
Figure 5:
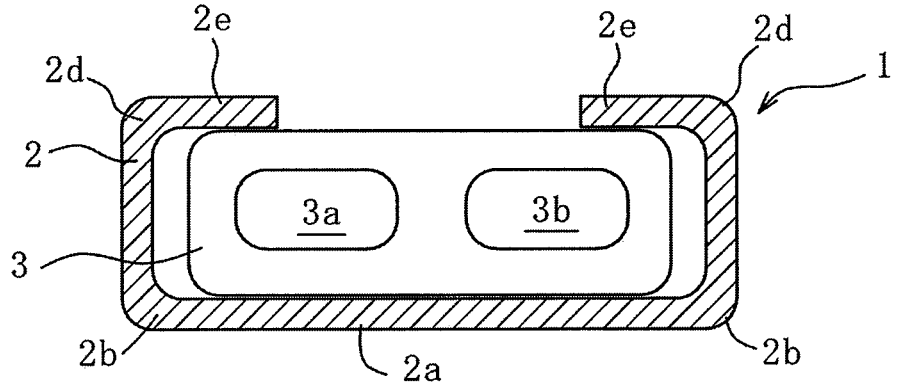
FIG. 5 is a front sectional view of a composite cross-section member showing another modification of FIG. 2D.

In the present embodiment, the case where the steel sheet 2 has the closed cross-sectional shape has been described, but welding may be applied to a joint 2*f* (cf. FIG. 4) in order to make the steel sheet 2 more complete closed cross-section. Further, the shape of the steel sheet 2 is not limited to the closed cross-section, and may be, for example, an open cross-sectional shape (cf. FIG. 5).

Second Embodiment

Figure 6:
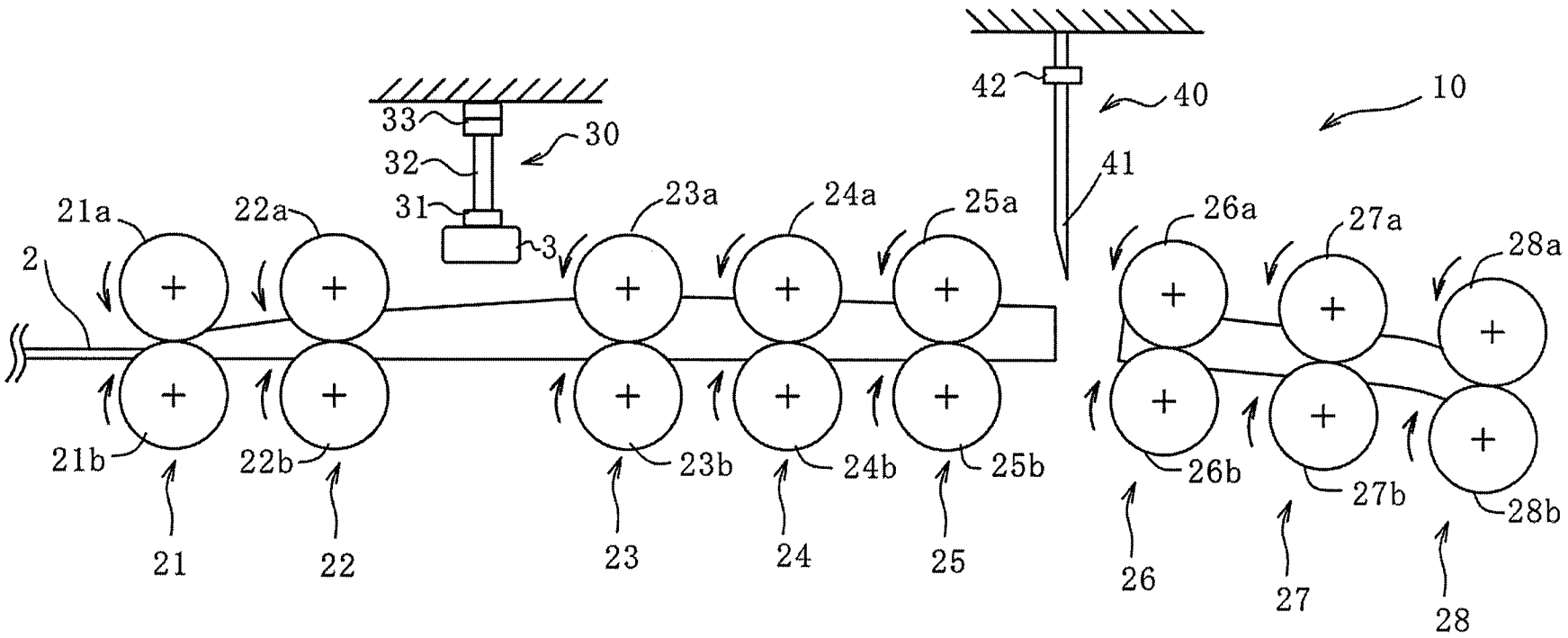
FIG. 6 is a side view of a device for manufacturing a composite cross-section member according to a second embodiment of the present invention.

In a device for manufacturing the composite cross-section member 1 of a second embodiment shown in FIG. 6, the placement of the cutter 40 is changed, and the vertical arrangement of the roll pairs 26 to 28 after the sixth step is changed. Except for these points, the present embodiment is substantially the same as the first embodiment of FIG. 1. Therefore, description of portions similar to those shown in FIG. 1 will be omitted.

In the present embodiment, the cutter 40 is disposed between the fifth step and the sixth step. The cutter 40 is the same as the cutter of the first embodiment.

The roll pairs 26 to 28 in the sixth and subsequent steps of the present embodiment are arranged offset downward in a curved manner as compared with the arrangement of the first embodiment (cf. FIG. 1). Therefore, the fed steel sheet 2 is not transferred linearly, but transferred downward in the curved manner and bent and formed in the fed direction.

According to the method of the present embodiment, by bending the composite cross-section member 1 which has the core 3 inside, a bending shape can be imparted to the composite cross-section member 1, and the core 3 can be caulked to the steel sheet 2 and fixed thereto.

Third Embodiment

Figure 7:
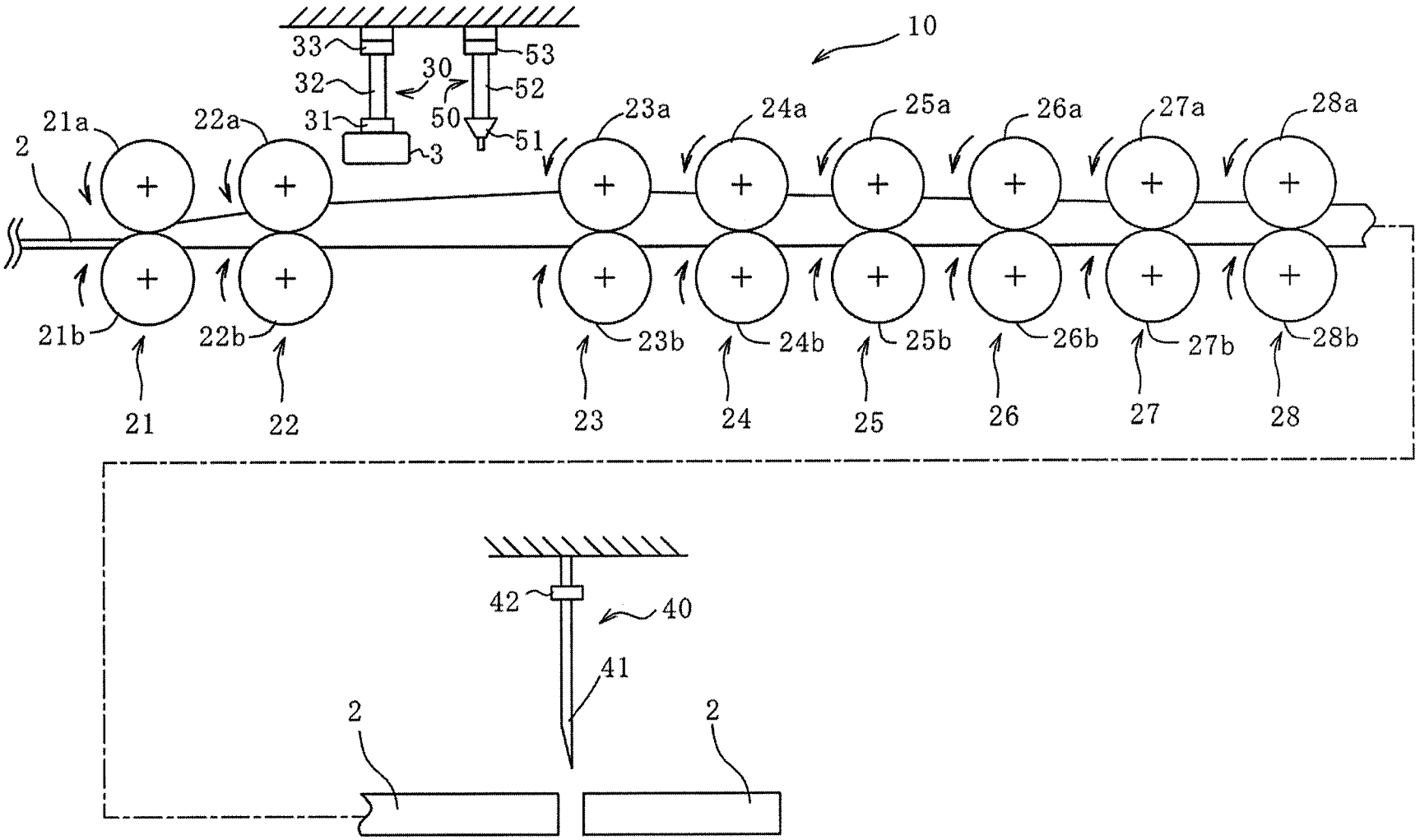
FIG. 7 is a side view of a device for manufacturing a composite cross-section member according to a third embodiment of the present invention.

In the device for manufacturing the composite cross-section member 1 of the third embodiment shown in FIG. 7, an adhesive coater 50 is added. Except for this point, the present embodiment is substantially the same as the first embodiment of FIG. 1. Therefore, description of portions similar to those shown in FIG. 1 will be omitted.

In the present embodiment, the adhesive coater 50 for applying an adhesive (insulator) 4 to the core 3 is provided between the second step and the third step and on the downstream of the robot arm 30. The adhesive coater 50 includes a nozzle 51, an arm 52, and an operation unit 53. The nozzle 51 is disposed at the lower end of the adhesive coater 50 and is a portion for discharging the adhesive 4. One end of the arm 52 is connected to the nozzle 51, and the other end thereof is connected to the operation unit 53. The operation unit 53 is a portion that causes the arm 52 to operate and causes the nozzle 51 connected to the arm 52 to operate vertically and horizontally. Hence, the robot arm 30 can apply the adhesive 4 to an arbitrary position of the core 3. An insulating material is used as the adhesive 4, and the adhesive 4 is applied to at least a part of the contact portion between the steel sheet 2 and the core 3. Although the adhesive 4 is applied in the present embodiment, the applied material is not limited to the adhesive and may only be an insulator. Therefore, for example, a foaming agent or the like with insulating properties is usable. The adhesive coater 50 may be disposed at an arbitrary position during the forming process as long as being downstream of the robot arm 30 and is not limited to between the second and third stage roll pairs 22 and 23.

Figure 8:
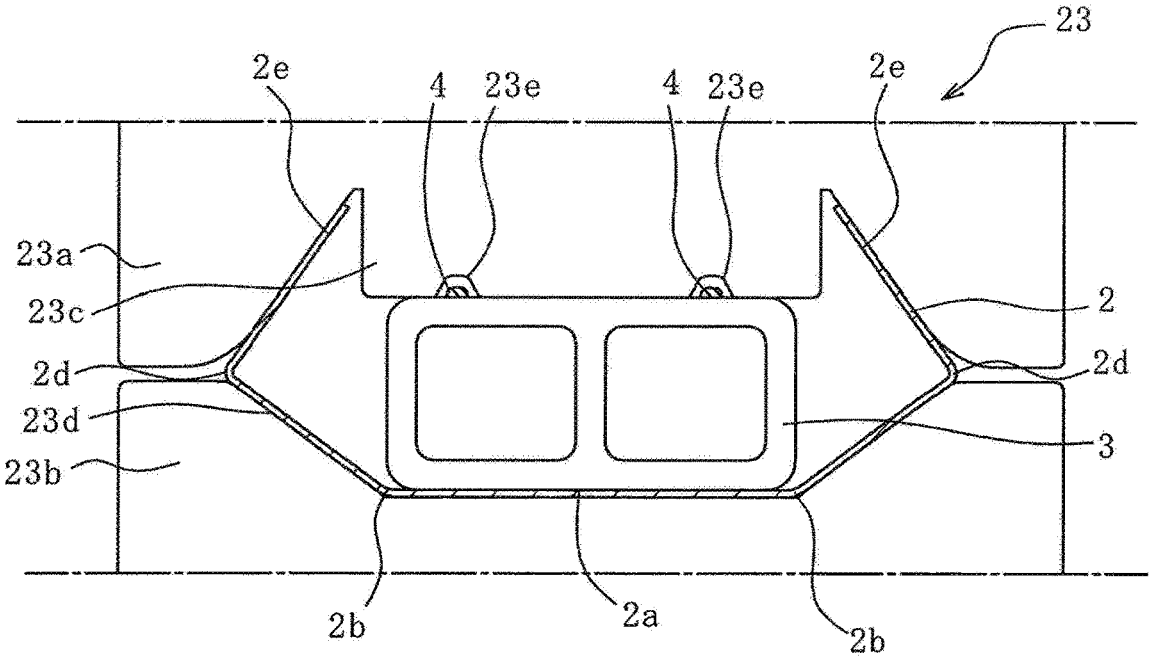
FIG. 8 is a partial front sectional view of a third step of FIG. 7.

As shown in FIG. 8, in the roll pairs downstream of the adhesive coater 50, that is, in the third and subsequent roll pairs 23 to 28 in the present embodiment, the convex portions 23*c* to 28*c* of the upper rolls 23*a* to 28*a* are provided with escape portions 23*e* to 28*e* corresponding to the portions to which the adhesive 4 is applied. The escape portions 23*e* to 28*e* are formed by notching a part of the convex portions 23*c* to 28*c* and are provided such that the applied adhesive 4 does not come into contact with the convex portions 23*c* to 28*c* of the upper rolls 23*a* to 28*a*.

According to the method of the present embodiment, electrolytic corrosion in a dissimilar metal can be prevented by applying the adhesive 4 with insulating properties to the joint portion between the steel sheet 2 and the core 3. Note that the adhesive 4 may be applied to the core 3 by the adhesive coater 50 during the forming as in the present embodiment or may be previously applied to the core 3 before the forming. Alternatively, the adhesive 4 may be applied to the steel sheet 2 instead of the core 3.

Further, by providing the escape portions 23*e* to 28*e* in the convex portions 23*c* to 28*c* of the upper rolls 23*a* to 28*a*, the adhesive 4 does not adhere to the roll pairs 23 to 28. Therefore, the roll former 10 can be used continuously without the need for maintenance such as cleaning.

Although the specific embodiments of the present invention and the modifications thereof have been described above, the present invention is not limited to the above embodiments, and various modifications can be made within the scope of the present invention. For example, a combination of contents of the individual embodiments as appropriate may be one embodiment of the present invention.

The invention claimed is:

1. A method for manufacturing a composite cross-section member, the method comprising:

feeding a continuous metal strip to a roll former for bending and roll forming the metal strip into a predetermined cross-sectional shape;

locally inserting a discontinuous light-metal core at an arbitrary stage of the roll forming; and bending the metal strip so as to integrate the core and the metal strip and obtaining a composite cross-section member, wherein the discontinuous light-metal core has a predetermined length that is equal to or smaller than a length between an adjacent pair of rolls of the roll former.

2. The method for manufacturing a composite cross-section member according to claim 1, wherein the roll former includes an upper roll and a lower roll that has a complementary shape with the upper roll, and a distance between the upper roll and the lower roll in a process after the insertion of the core matches a total of a thickness of the core and a thickness of the metal strip.

3. The method for manufacturing a composite cross-section member according to claim 2, further comprising disposing an insulator on at least a part of a contact portion between the metal strip and the core.

4. The method for manufacturing a composite cross-section member according to claim 3, wherein the roll former is provided with an escape portion corresponding to a portion where the insulator is disposed.

5. The method for manufacturing a composite cross-section member according to claim 2, further comprising:

cutting the composite cross-section member into a predetermined length; and bending the composite cross-section member with respect to a direction in which the metal strip is fed.

6. The method for manufacturing a composite cross-section member according to claim 2, further comprising forming the metal strip into a predetermined cross-sectional shape and then welding the metal strip into a closed cross-sectional shape.

7. The method for manufacturing a composite cross-section member according to claim 1, further comprising disposing an insulator on at least a part of a contact portion between the metal strip and the core.

8. The method for manufacturing a composite cross-section member according to claim 7, wherein the roll former is provided with an escape portion corresponding to a portion where the insulator is disposed.

9. The method for manufacturing a composite cross-section member according to claim 1, further comprising:

cutting the composite cross-section member into a predetermined length; and bending the composite cross-section member with respect to a direction in which the metal strip is fed.

10. The method for manufacturing a composite cross-section member according to claim 1, further comprising forming the metal strip into a predetermined cross-sectional shape and then welding the metal strip into a closed cross-sectional shape.

11. The method of manufacturing a composite cross-section member according to claim 1, wherein the inserting further comprises:

causing a robot arm to grip the discontinuous light-metal core, and causing the robot arm to insert and place the discontinuous light-metal core within a concave portion of the predetermined cross-sectional shape of the metal strip.

12. The method of manufacturing a composite cross-section member according to claim 9, wherein the bending further comprises: bending the composite cross-section member by the roll former with respect to the direction in which the metal strip is fed.

* * * * *